US006734150B2

(12) United States Patent
Gao et al.

(10) Patent No.: US 6,734,150 B2
(45) Date of Patent: May 11, 2004

(54) LUBRICATING OIL COMPOSITIONS

(75) Inventors: Jason Zhisheng Gao, Rose Valley, PA (US); Christopher John May, Sarnia (CA); Jeffrey Robert Torkelson, Woolwich, NJ (US); Paul Simon Woolley, Morecambe (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/181,860

(22) PCT Filed: Feb. 8, 2001

(86) PCT No.: PCT/US01/09730

§ 371 (c)(1),
(2), (4) Date: Nov. 12, 2002

(87) PCT Pub. No.: WO01/60959

PCT Pub. Date: Aug. 23, 2001

(65) Prior Publication Data

US 2004/0014615 A1 Jan. 22, 2004

(30) Foreign Application Priority Data

Feb. 14, 2000 (GB) ..... 0003388

(51) Int. Cl.[7] ..... C10M 141/02; C10M 141/12

(52) U.S. Cl. ..... 508/364; 508/363; 508/501; 508/503

(58) Field of Search ..... 508/363, 364, 508/501, 503

(56) References Cited

U.S. PATENT DOCUMENTS

| | | | | | |
|---|---|---|---|---|---|
| 5,888,945 | A | * | 3/1999 | Stiefel et al. | 508/363 |
| 5,925,600 | A | * | 7/1999 | Atherton | 508/364 |
| 6,074,993 | A | * | 6/2000 | Waddoups et al. | 508/364 |
| 6,110,878 | A | * | 8/2000 | McConnachie et al. | 508/363 |
| 6,143,701 | A | * | 11/2000 | Boffa | 508/363 |
| 6,150,309 | A | * | 11/2000 | Gao et al. | 508/364 |
| 6,232,276 | B1 | * | 5/2001 | Stiefel et al. | 508/363 |
| 6,358,894 | B1 | * | 3/2002 | Leta et al. | 508/363 |

* cited by examiner

*Primary Examiner*—Jacqueline V. Howard
(74) *Attorney, Agent, or Firm*—Norby L. Foss

(57) ABSTRACT

This invention relates to a lubricating oil composition comprising a base stock and an antioxidant comprising an oil soluble trinuclear organomolybdenum compound of the generic formula: $Mo_3S_x$—(Q) (1) wherein x is from 4 to 10 and Q is a core group, which may be a ligand, and at least one other compound selected from a phenolic and an aminic compound wherein the basestock has a kinematic viscosity at 100° C. ($KV_{100}$) from about 2 cSt to 20 cSt ($2\times10^{-6}$ to $20\times10^{-6}$ $m^2$/sec) and a saturates content of at least 85%. The composition has a high oxidation stability, reduced deposit formation and is capable of giving rise to good fuel economy improvement.

9 Claims, No Drawings

LUBRICATING OIL COMPOSITIONS

This invention relates to lubricating oil compositions, especially lubricants used in internal combustion engines, comprising base oils high in saturates which are resistant to oxidation.

Lubricating oil compositions are used for the smooth operation of internal combustion engines, power transmission components including automatic transmissions, shock absorbers and power steering devices and gears. The engine oils for internal combustion engines in particular serve to (i) lubricate various sliding interfaces eg between the piston ring and cylinder liner, in bearings of the crank shaft and the connecting rod, and in the valve driving mechanism including cams and valve lifters, (ii) cool the engine, (iii) clean and disperse the combustion products and (iv) prevent corrosion and consequent rust formation. The stringent requirements for high performance engines in recent years has meant greater demand from lubricants used in such engines. Lubricating oils used in such engines usually deteriorate due to oxidation by oxygen and nitrogen oxides (NOx) formed during combustion of fuels and lubricants and that contained in blow-by gas in turn formed by leakage of combustion gases into the crankcase via the piston and cylinder interface. The concentration of NOx increases in the blow-by gas with increasing demand in performance of the engine. The deleterious effects of oxidation can be and have been mitigated by the use of various additives including antioxidants, anti-wear agents, ash-free detergent dispersants, friction modifiers and the like.

Hitherto these have been mitigated to some extent by the use of lubricating compositions which comprise a Group I base oil which is relatively low in saturated hydrocarbons (hereafter "saturates") in spite of its relatively high propensity to oxidation. Whilst this has meant that the base oil itself is relatively inexpensive, it has had to be supplemented with relatively large amounts of additives/antioxidants to achieve the desired performance. However, by using a relatively more refined feedstock such as the Group II & Group III basestocks high in saturates, it is possible to achieve the desired performance without unduly supplementing the additives/antioxidants used.

It has now been found that by using a specific combination of antioxidants, it is possible to use Group II and Group III base stocks high in saturates with enhanced performance in respect of oxidation stability and fuel efficiency.

Accordingly, the present invention is a lubricating oil composition comprising a base stock and an antioxidant comprising an oil soluble trinuclear organomolybdenum compound of the generic formula:

$$Mo_3S_x—(Q) \quad (I)$$

wherein x is from 4 to 10, preferably 7, and Q is a core group, which may be a ligand, and at least one other compound selected from a phenolic and an aminic compound characterised in that the base stock has a kinematic viscosity at 100° C. ($KV_{100}$) from about 2 cSt to 20 cSt ($2\times10^{-6}$ to $20\times10^{-6}$ $m^2$/sec) and a saturates content of at least 85%.

The lubricating oil compositions of the present invention are those that comprise a major amount of a Group II or Group III base stock which may be a natural or synthetic lubricating oil having a $KV_{100}$ of 2–20 cSt, preferably from 2–12 cSt and a saturates content of at least 85%, preferably at least 88%. Specific examples of Group II basestock high in saturates include inter alia RLOP 500R and Mobil Jurong 500N (with >97% saturates), and MXT 5 (with 92% saturates); and examples of Group III basestock include inter alia Yubase 4 (with saturate contents of 99.5%) and Yubase 6 (with saturate contents of 97.5%).

According to a further embodiment, the present invention is a method of stabilizing a lubricant composition against oxidative degradation, said composition comprising a base stock which has a kinematic viscosity at 100° C. ($KV_{100}$) from about 2 cSt to 20 cSt ($2\times10^{-6}$ to $20\times10^{-6}$ $m^2$/sec) and a saturates content of at least 85% said method comprising adding to the basestock an effective amount of an antioxidant comprising an oil soluble trinuclear organomolybdenum compound of the generic formula:

$$Mo_3S_x—(Q) \quad (I)$$

wherein x is from 4 to 10, preferably 7, and Q is a core group, which may be a ligand, and at least one other compound selected from a phenolic and an aminic compound.

The trinuclear molybdenum compounds are of formula (I)

$$Mo_3S_x—(Q) \quad (I)$$

wherein x is from 4 to 10, preferably 7, and Q is a core group. These compounds are relatively new and are claimed and described in our prior published U.S. Pat. No. 5,906,968. The matter disclosed in this prior U.S. patent on the structure, preparation and properties of the trinuclear molybdenum compounds is incorporated herein by reference. In these compounds the core group (Q) may be a ligand capable of rendering the organomolybdenum compound of formula (I) oil soluble and ensuring that said molybdenum compound is substantially charge neutral. The core group (Q) is generally associated with suitable ligands such as L, wherein L is the ligand and y is of a sufficient number, type and charge to render the compound of formula (I) oil soluble and to neutralise the charge on the compound of formula (I) as a whole. Thus, more specifically, the trinuclear molybdenum compound used in the compositions of the present invention may be represented by the formula (II):

$$Mo_3S_xL_y \quad (II)$$

The ligands "L" are suitably dihydrocarbyl dithiocarbamates of the structure ($—S_2CNR_2$) wherein the dihydrocarbyl groups, $R_2$ impart oil solubility to the molybdenum compound. In this instance, the term "hydrocarbyl" denotes a substituent having carbon atoms directly attached to the remainder of the ligand and is predominantly hydrocarbyl in character within the context of this invention. Such substituents include the following:

(1) hydrocarbon substituents, ie, aliphatic (for example alkyl or alkenyl), alicyclic (for example cycloalkyl or cycloalkenyl), aromatic-, aliphatic- and alicyclic-substituted aromatic nuclei and the like, as well as cyclic substituents wherein the ring is completed through another portion of the ligand (that is, any two indicated substituents may together form an alicyclic group);

(2) substituted hydrocarbon substituents, ie, those containing nonhydrocarbon groups which, in the context of this invention, do not alter the predominantly hydrocarbyl character of the substituent. Those skilled in the art will be aware of suitable groups (eg halo (especially chloro), amino, alkoxyl, mercapto, alkylmercapto, nitro, nitroso, sulphoxy etc.); and (3) hetero substituents, ie, substituents which, while predominantly hydrocarbon in character within the context of this invention, contain atoms other than carbon present in a chain or ring otherwise composed of carbon atoms.

The hydrocarbyl groups are preferably alkyl (e.g. in which the carbon atom attached to the remainder of the ligand "L" is primary, secondary or tertiary), aryl, substituted aryl and/or ether groups.

Importantly, the hydrocarbyl groups of the ligands should be such that they have a sufficient number of carbon atoms to render the compound (I) soluble or dispersible in the oil to which the trinuclear organomolybdenum compound containing the ligand is added. The total number of carbon atoms present among all of the hydrocarbyl groups of the organomolybdenum compounds' ligands is suitably at least 21, preferably at least 25, more preferably at least 30 and even more preferably at least 35, typically e.g., 21 to 800. For instance, the number of carbon atoms in each hydrocarbyl group will generally range from 1 to 100, preferably from 1 to 40 and more preferably from 3 to 20.

The antioxidant in the compositions of the present invention suitably also include at least one other compound selected from a phenolic compound and an aminic compound. Among the phenolic compounds, hindered phenols are preferred.

Examples of such phenolic compounds include inter alia:

4,4'-methylene bis(2,6-di-tert-butylphenol)
4,4'-bis(2,6-di-tert-butylphenol)
4,4'-bis(2-methyl-6-tert-butylphenol)
2,2'-methylene bis(4-ethyl-6-tert-butylphenol)
2,2'-methylene bis(4-methyl-6-tert-butylphenol)
4,4'-butylidene bis(3-methyl-6-tert-butylphenol)
4,4'-isopropylidene bis(2,6-di-tert-butylphenol)
2,2'-methylene bis(4-methyl-6-nonylphenol)
2,2'-isobutylidene bis(4,6-dimethyl phenol)
2,2'-methylene bis(4-methyl-6-cyclohexylphenol)
2,6-di-tert-butyl-4-methylphenol
2,6-di-tert-butyl-4-ethylphenol and
2,4-dimethyl-6-tert-butylphenol Specific hindered phenols which are preferred as the antioxidants may be represented by the generic formulae (III)–(IV) below in which $R_1$, $R_2$, and $R_3$ are the same or different alkyl groups from 3–9 carbon atoms and x and y are integers from 1 to 4.

(III)

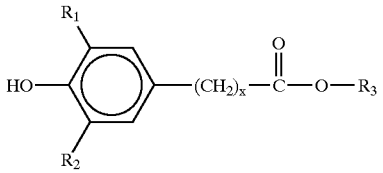

(IV)

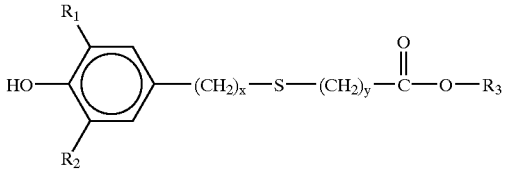

(V)

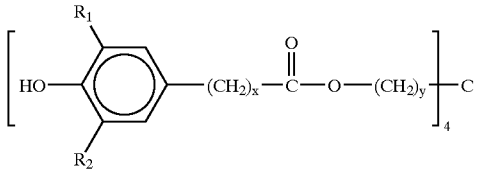

-continued (VI)

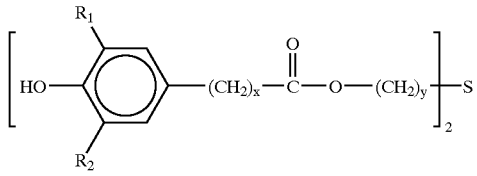

Suitable aminic compounds for use in the compositions of the present invention are diaryl amines, aryl naphthyl amines and alkyl derivatives of diaryl amines and the aryl naphthyl amines. Preferred aminic antioxidants are represented by the formulae (VII) and (VIII) wherein each of $R_4$ and $R_5$ is a hydrogen atom or represents the same or different alkyl groups from 1–8 carbon atoms.

(VII)

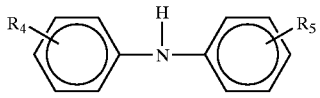

(VIII)

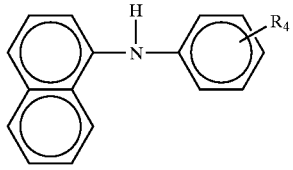

Specific examples of the aminic compounds that may be used in the compositions of the present invention include inter alia:

Monoalkyldiphenyl amines such as eg monooctyldiphenyl amine and monononyl diphenyl amine; dialkyldiphenyl amines such as eg 4,4'-dibutyldiphenyl amine, 4,4'-dipentyldiphenyl amine, 4,4'-dihexyldiphenyl amine, 4,4'-diheptyldiphenyl amine, 4,4'-dioctyldiphenyl amine and 4,4'-dinonyldiphenyl amine; polyalkyldiphenyl amines such as eg tetra-butyldiphenyl amine, tetra-hexyldiphenyl amine, tetra-octyldiphenyl amine and tetra-nonyldiphenyl amine; the naphthylamines such as eg α-naphthylamine and phenyl-α-naphthylamine; butylpheny-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Of these, dialkyldiphenyl amine and naphthylamines are preferable.

In general, the antioxidant which comprises the organomolybdenum compound in combination with a phenolic and/or an aminic compound will form a minor component of the total lubricant composition. For example, the organomolybdenum compound typically will comprise about 0.05 to about 5.00 wt % of the total composition, preferably from 0.05 to 2.0 wt %, and more preferably from 0.1 to 0.7 wt %, i.e., the molybdenum metal is suitably present in an amount of from about 25 to 2500 ppm, preferably from about 50 to 1000 ppm, and more preferably from 100 to 700 ppm, and the phenolic and/or aminic compounds about 0.10 to about 3.0 wt % of the total composition.

It has also been found that if the weight ratio of organomolybdenum compound to the phenolic and/or aminic compound in the antioxidant is in the range of about 80:20 to about 20:80, optimum dispersancy retention can be achieved by these combined antioxidants of the present invention.

It is particularly preferred that the antioxidant comprises in addition to the organo molybdenum compound, a mixture of the phenols (III)–(VI) above and the diaryl amines (VII)–(VIII) in a weight ratio ranging from about 80:10:10 to about 10:30:60 respectively, preferably typically 50:15:35 respectively.

Optionally, the antioxidants may be combined with a carrier liquid in the form of a concentrate. The concentration of the combined antioxidants in the concentrate may vary from 1 to 80% by weight, and will preferably be in the range of 5 to 50% by weight.

The antioxidant combination of the present invention can be used with any of the conventional dispersants used hitherto in the lubricating compositions. Examples of such dispersants include inter alia the polyalkylene succinimides, Mannich condensation products of polylalkylphenol-formaldehyde polyamine and boronated derivatives thereof. However, it is preferable to use ashless dispersants such as the ashless succinimides, especially the polyisobutenyl succinimides of a polyamine such as eg tetraethylenepentamine or its homologues, benzylamine ashless dispersants, and ester ashless dispersants. The dispersants are generally used in the compositions of the present invention in an amount ranging from about 2–10% by weight based on the total weight of the lubricant composition, preferably from about 4–8% by weight.

A feature of the present invention is that the compositions of the present invention the presence of a trinuclear organo molybdenum compound facilitates the control of deposit formation from engine oils. More specifically, formulations containing eg a contribution of 200–750 ppm, preferably from 450–550 ppm of Mo metal from the trimer and an additional contribution of from 80–100 ppm from a detergent inhibitor package enables the amount of deposit formed to be significantly reduced. Adverse effects, if any, due the presence of such molybdenum compounds in the formulation, eg copper strip corrosion, are readily mitigated by including in the formulation a corrosion inhibitor or a metal passivator. This reduction in deposit formation has been monitored by the so-called TEOST-MHT-2 test which test is similar to the conventionally used TEOST-33 test method except that it is run at a relatively lower temperature and for a longer time. These tests are especially designed to test the formulations for a GF-3 specification. The TEOST-33 test is carried out at temperature cycles which fluctuate from 200–500° C. and last for about 2 hours and results in bulk oxidation of the oil (about 100 g). In contrast, the TEOST-MHT-2 test relates to high temperature engine deposits as measured in tests such as TU3HT and is carried out at about 285° C. over 24 hours and is a thin-film test on about 8 g of oil. The TEOST-MHT-2 test measures deposits produced on a heated rod or in the oil itself (filtered residue) and the GF-3 specification is envisioned to specify a limit of 40 mg deposit. From the results in the Examples below it will be seen that the presence of a trinuclear organo molybdenum compound in such oils results in about 66% reduction in the total weight of the deposits formed which satisfies the GF-3 specification.

In general, these lubricating compositions may include additives commonly used in lubricating oils especially crankcase lubricants, such as antiwear agents, detergents, dispersants, rust inhibitors, viscosity index improvers, extreme-pressure agents, friction modifiers, corrosion inhibitors, emulsifying aids, pour point depressants, anti-foams and the like.

A feature of the present invention is that lubricant compositions comprising high saturates base oils and trinuclear organomolybdenum compounds in combination with a phenolic and/or an aminic compound as antioxidant provide unexpected improvement in oxidation control and significant benefits in fuel economy. In the case of lubricants compositions comprising high saturates base oils for diesel engine oils, the present invention confers the added benefits of viscosity increase control and dispersancy retention over compositions which contain only one of these antioxidants used alone.

The present invention is further illustrated with reference to the following Examples:

EXAMPLES

General Procedure

A series of Test oils were prepared. These oils were then tested in a bench oxidation test which was conducted at 165° C. under a mixed nitrogen/air flow, with 40 ppm iron from added ferric acetylacetonate as catalyst. The flow rates of air and nitrogen were controlled at 500 ml/min and 350 ml/min respectively.

In these tests the following commercial materials have been used:

| | |
|---|---|
| Irganox ® L57 | is an octylated/butylated diphenylamine (ex Ciba Geigy) |
| Irganox ® L101 | is a high molecular weight phenolic antioxidant (ex Ciba Geigy) |
| Irganox ® L115 | and Irganox ® L 1035 are high molecular weight phenolic antioxidants with a thioether group (ex Ciba Geigy) |
| Irganox ® L06 | is an alkylated phenyl-α-naphthylamine (ex Ciba Geigy) |
| Irganox ® L135 | is a high molecular weight phenolic antioxidant (ex Ciba Geigy) |
| Irganox ® L150 | is a mixture of alkylated diphenylamine, a phenolic antioxidant and a phenolic antioxidant with a thioether group (ex Ciba Geigy) |
| Paranox ® 106 | is a polyisobutenylsuccinimide dispersant (ex Infenium, Linden, NJ) |
| Molyvan ® 822 | is a dinuclear molybdenum dithiocarbamate containing 5% wt molybdenum (ex R T Vanderbilt Co) |
| PDN5203 | is an experimental sample of trinucler molybdenum dithiocarbamate containing 5% wt molybdenum |
| Paratone 8451 | is a viscosity index improver (ex Oronite) |
| Paraflow ® 390 | is a pour point depressant (ex Oronite) |
| DI | is a conventional detergent inhibitor package which is free of a friction modifier package |
| 120X | is a Group II base oil with >92% in saturates (ex.Imperial Oil, Canada) |

The same conventional DI package was used in all the Examples and tests, where indicated.

Examples A–I

Comparison Between Low and High Saturates Base Oils

The compositions of the test oils in these used in these Examples and their changes in respective viscosities after a 48 hour oxidation test are given in Table 1 below:

TABLE 1

| Example | A | B | C | D | E | F | G | H | I |
|---|---|---|---|---|---|---|---|---|---|
| MCT 30 (% wt) | 93.0 | 93.0 | 93.0 | — | — | — | — | — | — |
| RLOP 500R (% wt) | — | — | — | 93.0 | 93.0 | 93.0 | — | — | — |
| Mobil Jurong 500N (% wt) | — | — | — | — | — | — | 93.0 | 93.0 | 93.0 |
| Paranox ® 106 (% wt) | 6.0 | 6.0 | 6.0 | 6.0 | 6.0 | 6.0 | 6.0 | 6.0 | 6.0 |
| $Mo_3$-dithiocarbamate* | 1.0 | — | 0.5 | 1.0 | — | 0.5 | 1.0 | — | 0.5 |
| Irganox ® L57 | — | 1.0 | 0.5 | — | 1.0 | 0.5 | — | 1.0 | 0.5 |
| Fresh Oil $KV_{100}$, cSt | 12.99 | 13.18 | 13.06 | 12.87 | 12.64 | 12.78 | 12.6 | 12.31 | 12.38 |
| Used Oil $Ky_{100}$, cSt | 14.3 | 21.66 | 15.54 | 25.03 | 28.76 | 12.87 | 46.25 | 34.6 | 12.59 |
| % Increase** | 10.08 | 64.34 | 3.68 | 94.48 | 127.53 | 0.70 | 267.06 | 181.1 | 1.70 |

*containing 11.5% wt of molybdenum
**changes in viscosity after 48 hr oxidation tests.

From the above it can be seen that the trinuclear molybdenum dithiocarbamate and the diarylamine individually perform better in low saturates base oil, but, unexpectedly, a combination of the two gives a better performance in high saturates base oils than the individual components.

Examples J–O

Comparison Between a Trinuclear Molybdenum Compound and a Dinuclear Molybdenum Compound The compositions of the test oils in Examples J–Q and their respective changes in viscosity data after a 48-hour oxidation test on each are shown in Table 2 below:

TABLE 2

| Example | J | K | L | M | N | O | P | Q |
|---|---|---|---|---|---|---|---|---|
| MCT 30 (% wt) | 93.0 | 93.0 | 93.0 | 93.0 | — | — | — | — |
| RLOP 500R (% wt) | — | — | — | — | 93.0 | 93.0 | 93.0 | 93.0 |
| Paranox ® 106 (% wt) | 6.0 | 6.0 | 6.0 | 6.0 | 6.0 | 6.0 | 6.0 | 6.0 |
| PDN 5203 (wt %)* | 1.0 | — | 0.5 | — | 1.0 | — | 0.5 | — |
| Molyvan ® 822 (wt %) | — | 1.0 | — | 0.5 | — | 1.0 | — | 0.5 |
| Irganox ® L57 (wt %) | — | — | 0.5 | 0.5 | — | — | 0.5 | 0.5 |
| Fresh Oil $KV_{100}$, cSt | 12.98 | 13.00 | 12.91 | 12.97 | 12.65 | 12.71 | 12.64 | 12.63 |
| Used Oil $KV_{100}$, cSt | 16.19 | 24.94 | 13.59 | 13.93 | 78.99 | 79.50 | 12.77 | 12.87 |
| % Increase* | 24.7 | 91.8 | 5.3 | 7.4 | 524 | 526 | 1.0 | 1.9 |

*changes in viscosity after 48 hr oxidation tests.

Examples J–Q show that the trinuclear molybdnum dithiocarbamate gives better performance than conventional dinuclear molybdenum dithiocarbamate in oxidation control. The performance of the trinuclear molybdenum compound is further enhanced in base oils high in saturates.

Synergy of Trinuclear Molybdenum Dithiocarbamate with a Base Oil High in Saturates in the Presence of Antioxidant Mixtures Examples R–U The changes in viscosity after a 32 hour oxidation test in Examples R–U is shown in Table 3 below:

TABLE 3

| Example | R | S | T | U |
|---|---|---|---|---|
| MCT 30 (% wt) | 93.0 | 93.0 | — | — |
| RLOP 500R (% wt) | — | — | 93.0 | 93.0 |
| Paranox ® 106 (% wt) | 6.0 | 6.0 | 6.0 | 6.0 |
| $Mo_3$-dithiocarbamate* (% wt) | 0.5 | 0.5 | 0.5 | 0.5 |
| Irganox ® L57 | 0.5 | — | 0.5 | — |
| Irganox ® L150 (% wt) | — | 0.5 | — | 0.5 |
| Fresh Oil $KV_{100}$, cSt | 13.39 | 13.41 | 12.73 | 12.78 |

TABLE 3-continued

| Example | R | S | T | U |
|---|---|---|---|---|
| Used Oil $KV_{100}$, cSt | 13.64 | 13.62 | 12.78 | 12.82 |
| % Increase** | 1.87 | 1.57 | 0.39 | 0.31 |

*containing 11.5% by wt molybdenum
**changes in viscosity afier 48 hr oxidation tests.

Examples R–U demonstrate that mixtures of aininic and phenolic antioxidants give equivalent performance to an aminic antioxidant. Base oils high in saturates provide additional benefit in viscosity control.

Fuel Economy Improvement

Fuel economy is measured in different types of engine tests including the Sequence VIA, Sequence VIB and the M111 tests. Sequence VIA and the M111 tests evaluate initial fuel economy while Sequence VIB test determines initial and retained fuel economy after 96 hours.

In all engine tests, fuel economy is estimated as a function of the hydrodynamic and boundary contribution of the lubricant to fuel consumption. The lubricant contribution under hydrodynamic conditions is mostly governed by the lubricant viscometrics under both low and high shear conditions while the lubricant contributions under boundary conditions are most governed by the friction modifier technology.

For the purpose of illustrating this invention, we concentrate on the lubricant contribution to the boundary operating range of the engine, which in the Sequence VIB test is measured in Stage 5 of that test whereas the Sequence VIA is measured in Stage 1 of that test. The following Examples, therefore, refer to test performances in Stage 1, Stage 5 and the M111 tests as appropriate.

Example V

A 5W-20 formulation comprising a Group II base oil is shown in Table 4 below:

TABLE 4

| Component | Weight % | Component type |
|---|---|---|
| MXT 5 | 79.034 | Group II basestock |
| Paratone ® 8452* | 6.10 | OCP VI Improver |
| Parabar ® 9230** | 10.50 | Borated PIBSA-PAM dispersant |
| SAP 001** | 2.25 | Ca salicylate - 165 TBN |
| SAP007** | 0.56 | Mg salicylate - 345 TBN |
| Irganox ® L135 | 0.30 | High M W phenolic AOX |
| Parabar ® 9417** | 0.36 | Secondary ZnDDP |
| Paranox ® 15** | 0.69 | Primary ZnDDP |
| Parabar ® 10100** | 0.20 | Corrosion Inhibitor |
| Parabar ® 9499** | 0.006 | Demulsifier |

*Paratone ® 8452 is sold by Oronite, Richmond, California, USA
**Parabar ® , Paranox ® and SAP additives are sold by Infenium, Linden, New Jersey, USA.

The fuel economy and fuel economy retention data were collected using a gasoline passenger car M111 fuel economy test (CES-L54-X-94) and a M111 fuel economy retention test. In the M111 fuel economy retention test, the duration of the test is extended by repeating the standard test cycles 21 times. Each test cycle is followed by a period of steady state aging. The aging is equivalent to 500 miles. The total test is thus equivalent to about 10,000 miles, and takes about 185 hours. Fuel consumptions are measured at every cycle, hence every 500 miles. The fuel consumption reference RL191 is measured both at the beginning and end of the test, thereby allowing uninterrupted aging of the test oil. The effects of a trinuclear molybdenum dithiocarbamate on fuel economy and fuel economy retention are shown in Table 5 below. The initial fuel economy improvement data are thus based on comparison with the industry reference oil RL191 (which is a 15W-40 engine oil).

TABLE 5

| Formulation | Initial Fuel Economy / % | Integrated fuel economy improvement (vs base case) over 10,000 mile drain interval / % |
|---|---|---|
| Base case 5W-20 (Table 4) | 2.20 | — |
| Base case + 1.1% Sakaralube ® 155* | 2.38 | 10.6 |
| Base case + 0.2% PDN 5203 | 2.54 | 34.6 |
| Base case + 1.0% PDN 5203 | 2.73 | 36.2 |

*Sakaralube ® 155 is a dinuclear Mo dithiocarbamate (5% wt Mo, ex Asahi Denko Kogyo KK)

Example V shows that addition of molybdenum compounds leads to better fuel economy retention in a European gasoline passenger car engine. The use of trinuclear molybdenum dithiocarbamate provides significant improvement in initial fuel economy and fuel economy retention over the conventional dinuclear molybdenum dithiocarbamate.

Example W

A 5W-20 engine oil formulation comprising a Group III base oil is shown in Table 6 below:

TABLE 6

| Component | Weight % | Component type |
|---|---|---|
| Yubase 6 | 45.4 | Group III basestock |
| Yuabse 4 | 40.3 | Group III basestock |

TABLE 6-continued

| Component | Weight % | Component type |
|---|---|---|
| DI | 8.3 | DI package free of friction modifier |
| Paratone ® 8464* | 6.10 | OCP VI Improver |

*Paratone ® 8464 is sold by Oronite, Richmond, California, USA

The sequence VIA screener data in stages 1, 4 and 7 (stages sensitive to friction modifier) using a trinuclear molybdenum dithiocarbamate on fuel economy are shown in Table 7. The % fuel economy improvement was measured versus an industry baseline calibration oil (BC-3) for Sequence VIA (BC-3 is a non-friction modified synthetic 5W-30).

TABLE 7

| | % Fuel Economy Improvement | | |
|---|---|---|---|
| Formulation | Stage 1 | Stage 4 | Stage 7 |
| Base case (Table 6) | 0.612 | 1.804 | −0.622 |
| Base case + 1.0% PDN 5203 | 2.214 | 1.998 | 0.854 |

Thus, Example W further demonstrates the benefit of trinuclear molybdenum dithiocarbamate in fuel economy improvement in a North American gasoline engine.

Example X

The TEOST-MHT-2 test was performed in a manner very similar to the conventional TEOST-33 test for a GF-2 specification by running at a lower temperature (285° C.) but for a longer period of time ie 24 hours on an 8 g sample of oil. The test is set to measure deposits produced on a heated rod or in the oil itself (filtered residue) and it was expected to match the currently given GF-3 specification limit of 40 mg of deposit. The results are tabulated in Table 8 below:

TABLE 8

| | | Blend | |
|---|---|---|---|
| Components | Type | 5W-30 | 5W-30 |
| 120X (wt %) | Baseoil | 81.51 | 80.51 |
| DI (wt %) | Free of friction modifier | 8.29 | 8.29 |
| PDN5203 | Mo-trimer | — | 1.00 |
| Paratone ® 8451 | VI improver | 10.00 | 10.00 |
| Paraflow ® 390 | Pour point depressant | 0.20 | 0.20 |
| MHT-2 TEOST Test | | | |
| Filter wt (mg) | | 5.2 | 0.9 |
| Rod wt (mg) | | 70 | 26.4 |
| Total wt (mg) | | 75.2 | 27.3 |

We claim:

1. A lubricating oil composition comprising a base stock the having a kinematic viscosity at 100° C. ($KV_{100}$) from about 2 cSt to 20 cSt ($2\times10^{-6}$ to $20\times10^{-6}$ $m^2$/sec) and a saturates content of at least 85% and an antioxidant comprising an oil soluble trinuclear organomolybdenum compound of the generic formula:

$$Mo_3S_x—(Q) \quad (I)$$

wherein x is from 4 to 10, preferably 7, and Q is a core group, which may be a ligand, and a mixture of a phenolic compound of of formulae (III) to (VI):

(III)

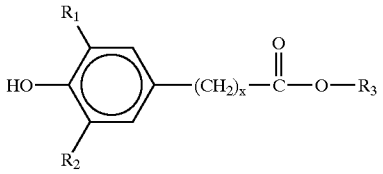

(IV)

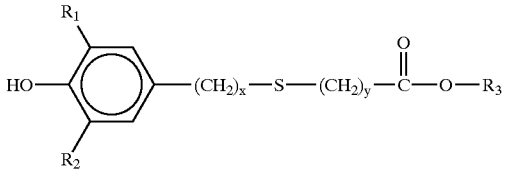

(V)

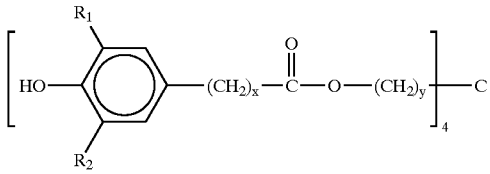

(VI)

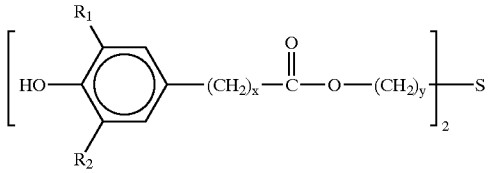

wherein $R_1$, $R_2$, and $R_3$ are the same or different alkyl groups from 3–9 carbon atoms and x and y are integers from 1 to 4 and of an aminic compound of formula (VII) or (VIII):

(VII)

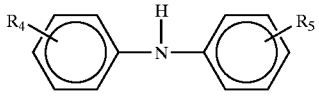

(VIII)

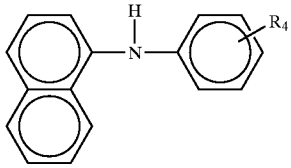

wherein each of $R_4$ and $R_5$ is a hydrogen atom or represents the same or different alkyl groups from 1–8 carbon atoms in a weight ratio ranging from about 80:10:10 to about 10:30:60 respectively.

2. A composition according to claim 1 wherein the basestock is a Group II or Group III base stock which may be a natural or synthetic lubricating oil having a $KV_{100}$ of 2–12 cSt.

3. A composition according to claim 1 wherein the trinuclear molybdenum compounds are of formula (I)

$$Mo_3S_x—(Q) \quad (I)$$

wherein x is 7 and Q is a core group.

4. A composition according to claim 3 wherein the core group Q is a ligand capable of rendering the organomolybdenum compound of formula (I) oil soluble and ensuring that said molybdenum compound is substantially charge neutral.

5. A composition according to claim 4 wherein the antioxidant which comprises the trinuclear organomolybdenum compound, the phenolic and the aminic compound forms a minor component of the total lubricant composition.

6. A composition according to any one of claims 1, 2 or 4 wherein the trinuclear organomolybdenum compound is present in said composition in an amount of about 0.05 to about 5.00 wt % of the total composition.

7. A composition according to claim 6 wherein the amount of phenolic and aminic compounds present in said composition is about 0.10 to about 3.0 wt % of the total composition.

8. A method of stabilizing a lubricant composition against oxidative degradation, said composition comprising a basestock which has a kinematic viscosity at 100° C. ($KV_{100}$) from about 2 cSt to 20 cSt ($2\times10^{-6}$ to $20\times10^{-6}$ $m^2$/sec) and a saturates content of at least 85% said method comprising adding to the basestock an effective amount of an antioxidant comprising an oil soluble trinuclear organomolybdenum compound of the generic formula:

$$Mo_3S_x—(Q) \quad (I)$$

wherein x is from 4 to 10, preferably 7, and Q is a core group, which may be a ligand, and a mixture of a phenol of formula:

(III)

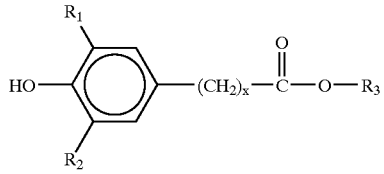

(IV)

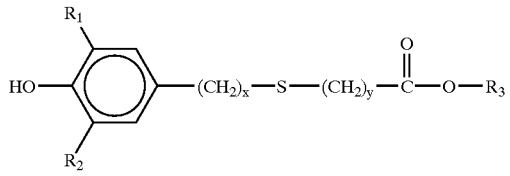

(V)

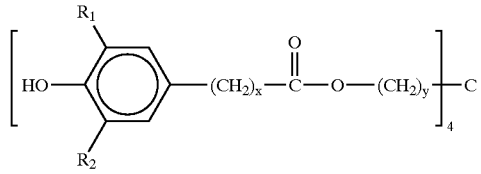

(VI)

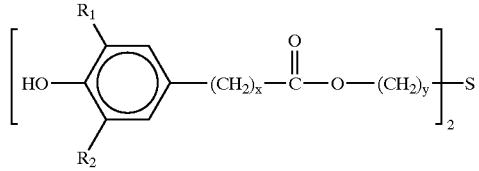

wherein $R_1$, $R_2$, and $R_3$ are the same or different alkyl groups from 3–9 carbon atoms and x and y are integers from 1 to 4 and of an aminic compound of formula:

(VII)

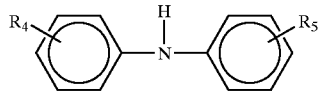

-continued (VIII)

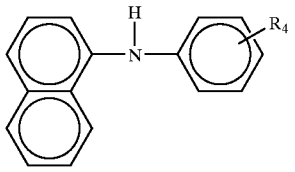

wherein each of $R_4$ and $R_5$ is a hydrogen atom or represents the same or different alkyl groups from 1–8 carbon atoms in a weight ratio ranging about from 80:10:10 to about 10:30:60 respectively.

9. A method of improving fuel economy of a lubricant composition, said composition comprising a basestock which has a kinematic viscosity at 100° C. ($KV_{100}$) from about 2 cSt to 20 cSt ($2\times10^{-6}$ to $20\times10^{-6}$ $m^2$/sec) and a saturates content of at least 85% said method comprising adding to the basestock an effective amount of an antioxidant comprising an oil soluble trinuclear organomolybdenum compound of the generic formula:

$$Mo_3S_x\text{—}(Q) \quad \text{(I)}$$

wherein x is from 4 to 10, preferably 7, and Q is a core group, which may be a ligand, and a mixture of a phenol of formula:

(III)

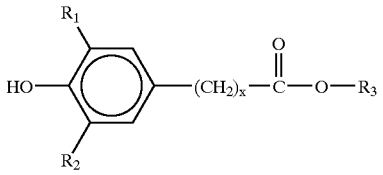

(IV)

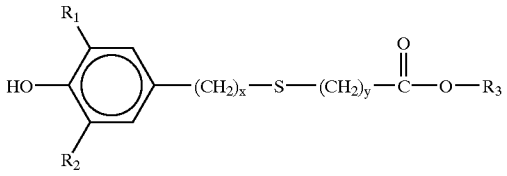

-continued (V)

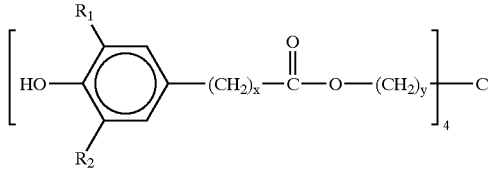

(VI)

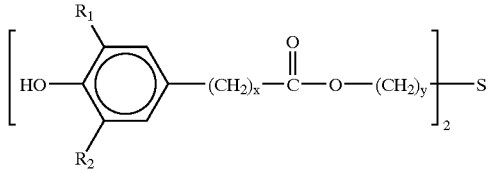

wherein $R_1$, $R_2$, and $R_3$ are the same or different alkyl groups from 3–9 carbon atoms and x and y are integers from 1 to 4 and of an aminic compound of formula:

(VII)

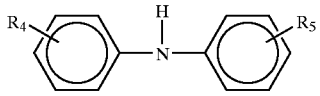

(VIII)

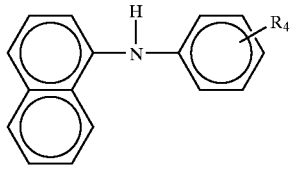

wherein each of $R_4$ and $R_5$ is a hydrogen atom or represents the same or different alkyl groups from 1–8 carbon atoms in a weight ratio ranging from about 80:10:10 to about 10:30:60 respectively.

* * * * *